US008090136B2

(12) United States Patent
Rashish et al.

(10) Patent No.: US 8,090,136 B2
(45) Date of Patent: Jan. 3, 2012

(54) HANDHELD ELECTRONIC DEVICE HAVING OFFSET SOUND OPENINGS

(75) Inventors: Ilan Rashish, Kitchener (CA); Robert Phillips, Waterloo (CA); Larry Hawker, Waterloo (CA)

(73) Assignee: Research in Motion Limited, Waterloo, Ontario (CA)

( * ) Notice: Subject to any disclaimer, the term of this patent is extended or adjusted under 35 U.S.C. 154(b) by 1367 days.

(21) Appl. No.: 11/194,080

(22) Filed: Jul. 29, 2005

(65) Prior Publication Data

US 2007/0025582 A1 Feb. 1, 2007

(51) Int. Cl.
*H04R 1/02* (2006.01)

(52) U.S. Cl. ..... 381/388; 379/433.11

(58) Field of Classification Search ..... 381/56, 381/371, 386, 344, 355, 351, 388; 345/168, 345/169; 455/90.1–90.3, 575.1, 575.3; 379/433.02, 379/433.01, 428.01–440, 433.11
See application file for complete search history.

(56) References Cited

U.S. PATENT DOCUMENTS 5,517,574 A * 5/1996 Tichy ..... 381/386
5,953,414 A 9/1999 Abraham et al.
6,493,456 B1 * 12/2002 Hansson ..... 381/345
6,553,119 B1 * 4/2003 Mori ..... 379/433.11
6,658,110 B1 12/2003 Andersen
6,993,129 B1 * 1/2006 Barr ..... 379/435
7,409,058 B2 * 8/2008 Holmes et al. ..... 379/433.02

FOREIGN PATENT DOCUMENTS

EP 1107542 A 6/2001
GB 2318476 * 4/1998
WO WO 2004/004408 A 1/2004

* cited by examiner

*Primary Examiner* — Xu Mei
*Assistant Examiner* — Lun-See Lao
(74) *Attorney, Agent, or Firm* — McCarthy Tétrault LLP

(57) ABSTRACT

An improved handheld electronic device has a case with an elongated cavity formed therein. An audio transducer is in fluid communication with the cavity, and a number of sound openings are formed in the case and are in fluid communication with the cavity and with the atmosphere surrounding the handheld electronic device. The sound openings are generally spaced from a central region of the audio transducer to space the sound openings generally farther from an edge of the case than the audio transducer. The cavity is configured to form a Helmholtz resonator that enables the communication of sound through the cavity between the audio transducer and the sound openings. The spacing of the sound openings from an edge of a case helps a user to form a seal between the case and the user's ear to enable sound from the sound openings to enter the ear and to be perceived by the user.

18 Claims, 4 Drawing Sheets

HANDHELD ELECTRONIC DEVICE HAVING OFFSET SOUND OPENINGS

BACKGROUND

1. Field

The invention relates generally to handheld electronic devices and, more particularly, to a handheld electronic device having a number of sound openings that are spaced from an audio transducer.

2. Description of the Related Art

Numerous types of handheld electronic device are known. Examples of such handheld electronic devices include, for instance, personal data assistants (PDAs), handheld computers, two-way pagers, cellular telephones, and the like. Many handheld electronic devices also feature a wireless communication capability, although many such handheld electronic devices are stand-alone devices that are functional without communication with other devices.

Handheld electronic devices are generally intended to be portable and thus are of a relatively compact configuration. With advances in technology, handheld electronic devices are built to have progressively smaller form factors yet have progressively greater number of applications and features resident thereon.

Certain handheld electronic devices have loudspeakers that are intended to be placed against the ear of a user. Such handheld electronic devices would include telephones and electronic devices having a telephone capability. Devices of this type typically include an audio transducer, i.e., a loudspeaker, disposed within a case at an end of the case. The case typically includes one or more sound openings formed therein adjacent a sound-producing element of the audio transducer. The sound openings provide fluid communication between the audio transducer and the atmosphere surrounding the handheld electronic device to enable sounds produced by the audio transducer to be transmitted to the atmosphere and to be heard by a user. While such devices have been generally effective for their intended purposes, such devices have not, however, been without limitation.

An electronic device having a loudspeaker that is intended to be held to the ear typically has a low output volume. In order for sound from the audio transducer to be received within the ear of the user, the outer ear desirably forms a seal with an outer surface of the electronic device in the region surrounding a sound opening. On some devices such as a conventional telephone, a seal can be achieved between the electronic device and the outer ear merely by placing the device against the outer ear. However, with relatively small handheld electronic devices, the sound openings can be disposed sufficiently close to an edge of the electronic device that an effective seal between the handheld electronic device and the user's ear can be difficult to establish. This is particularly the case with relatively small handheld electronic devices that are configured to include a relatively small output transducer as the loudspeaker. Such an output transducer is often disposed within a case as close as possible to an edge of the case for reasons of compactness. That is, a handheld electronic device typically will not include other electronic components that are disposed, for instance, between the audio transducer and the edge of the case. Handheld electronic devices of today typically employ printed circuit board architecture, with the result that electronic components typically will not be remote from the printed circuit board and disposed between an audio transducer and an interior edge of a case. To intentionally space an audio transducer from an edge of a case would typically result in the electronic device having a void region between the audio transducer and the edge of the case since such a region typically would not be occupied by other components of the electronic device. The result would be a case that is unnecessarily long and having undesirable void regions within an interior thereof.

It thus would be desirable to provide an alternative configuration that can overcome at least some of the aforementioned shortcomings in the art.

SUMMARY OF THE INVENTION

An improved handheld electronic device has a case with an elongated cavity formed therein. An audio transducer is in fluid communication with the cavity, and a number of sound openings are formed in the case and are in fluid communication with the cavity and with the atmosphere surrounding the handheld electronic device. The sound openings are generally spaced from a central region of the audio transducer to space the sound openings generally farther from an edge of the case than the audio transducer. The cavity is configured to form a Helmholtz resonator that enables the communication of sound through the cavity between the audio transducer and the sound openings. The spacing of the sound openings from an edge of a case helps a user to form a seal between the case and the user's ear to enable sound from the sound openings to enter the ear and to be perceived by the user.

Accordingly, an aspect is to provide an improved handheld electronic device having a number of sound openings that are spaced from an edge of a case of the handheld electronic device to help a user form a seal between a surface of the handheld electronic device and the user's ear such that sound output from the sound openings can be received in the ear.

Another aspect is to provide an improved handheld electronic device that can be configured to be relatively compact.

Another aspect is to provide an improved handheld electronic device having a cavity that can be configured as a Helmholtz resonator to provide a desired frequency response between an audio transducer and a sound opening formed in a case of the handheld electronic device.

Another aspect is to provide an improved handheld electronic device that is relatively easier to use than other known devices due to its enhanced audio output characteristics.

Accordingly, an aspect is to provide an improved handheld electronic device, the general nature of which can be stated as including a case comprising a housing and a cover, the housing having a first housing surface and the cover having a first cover surface, and an output apparatus comprising an audio transducer disposed on the housing. The case has an indentation formed in at least one of the housing adjacent the first housing surface and the cover adjacent the first cover surface. At least a portion of the first cover surface is disposed on at least a portion of the first housing surface. The indentation is disposed between and forms a cavity in the case between at least a portion of the housing adjacent the first housing surface and at least a portion of the cover adjacent the first cover surface, with the cavity being elongated along at least a first axis. The audio transducer is in fluid communication with the cavity. The case has at least a first opening formed therein in fluid communication with the cavity and the atmosphere. The at least a first opening is spaced along the at least a first axis from the audio transducer.

Another aspect is to provide an improved handheld electronic device, the general nature of which can be stated as including a case having a cavity formed therein, the cavity being elongated along at least a first axis, and an operational apparatus that includes an output apparatus comprising an audio transducer and a structure disposed on the case. The audio transducer is disposed adjacent the structure, and the cavity extends between a first position adjacent the audio transducer and a second position adjacent the structure. The audio transducer is in fluid communication with the cavity. The case has at least a first opening formed therein in fluid communication with the cavity and with the atmosphere. The at least a first opening is spaced along the at least a first axis from the audio transducer.

Another aspect is to provide an improved handheld electronic device, the general nature of which can be stated as including a case comprising a housing and a lens, the housing having a first housing surface and the lens having a first lens surface, a processor apparatus comprising a processor and a memory disposed on the housing, and an output apparatus comprising an audio transducer and a display disposed on the housing, the display comprising a screen and a connection apparatus connected with the processor apparatus. The housing has an interior region formed therein. The housing has a window formed therein in communication with the interior region, with at least a portion of the first housing surface being disposed adjacent the window. At least a portion of the display is disposed within the interior region adjacent the window, and at least a portion of the first lens surface is disposed on at least a portion of the first housing surface. The lens is at least partially translucent, and at least a portion of the lens overlies at least a portion of the window and at least a portion of the screen adjacent the window. The case has an indentation formed in at least one of the housing adjacent the first housing surface and the lens adjacent the first lens surface, with the indentation being disposed between and forming a cavity in the case between at least a portion of the housing adjacent the first housing surface and at least a portion of the lens adjacent the first lens surface. The audio transducer is in fluid communication with the cavity. The case has at least a first opening formed therein in fluid communication with the cavity and the atmosphere.

BRIEF DESCRIPTION OF THE DRAWINGS

A further understanding can be gained from the following Description of the Preferred Embodiment when read in conjunction with the accompanying drawings in which.

Similar numerals refer to similar parts throughout the specification.

DESCRIPTION OF THE PREFERRED EMBODIMENT

Figure 1:
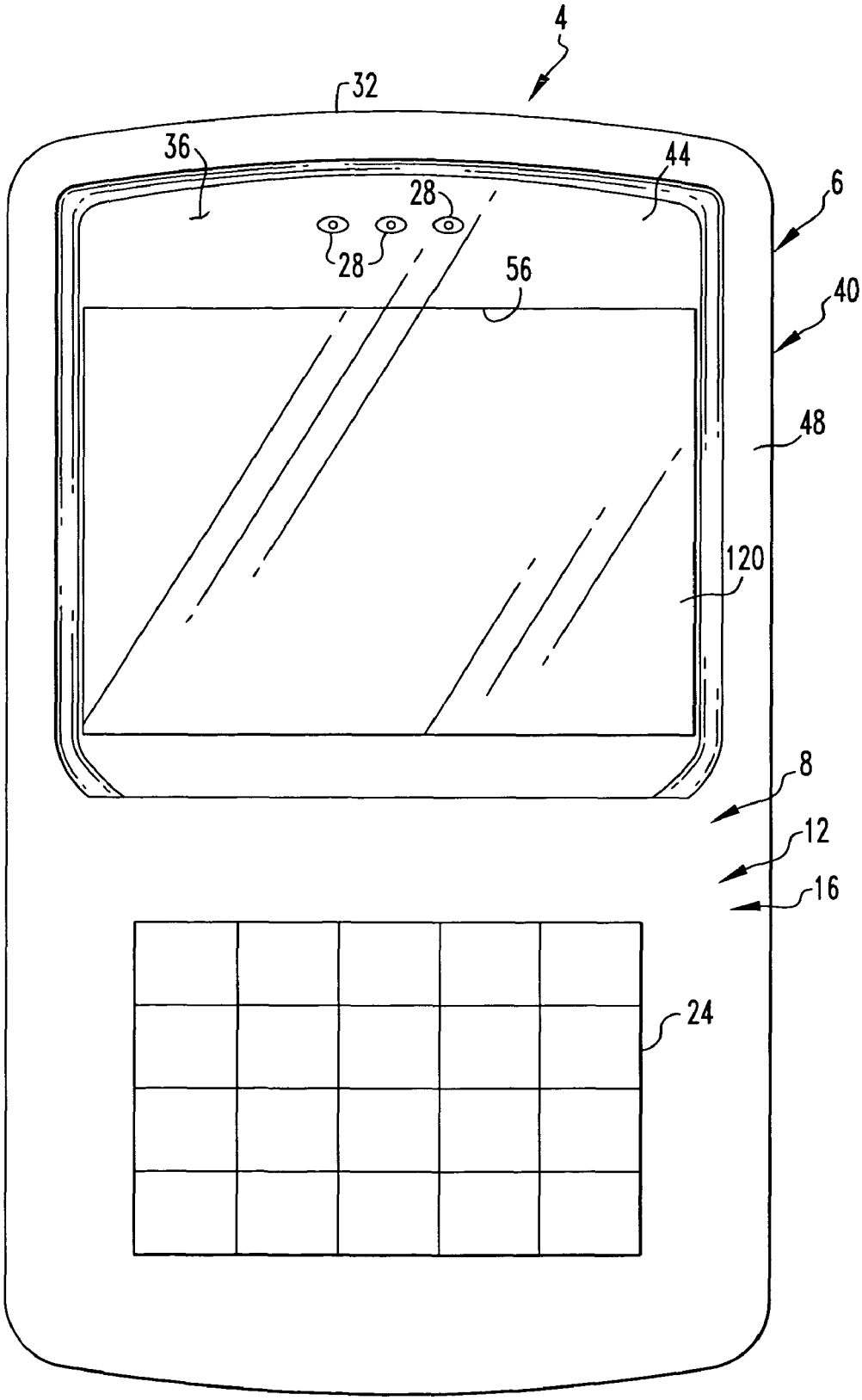
FIG. 1 is a front elevational view of an improved handheld electronic device.
Figure 2:
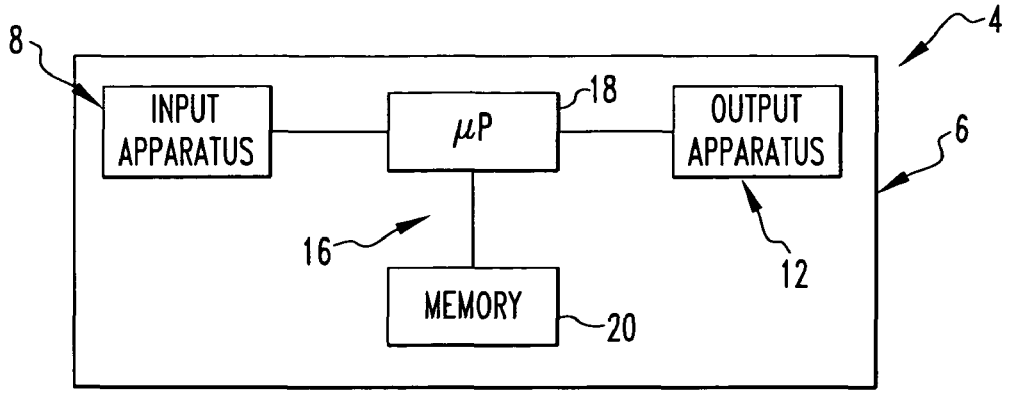
FIG. 2 is a schematic depiction of the handheld electronic device of FIG. 1.

An improved handheld electronic device 4 is indicated generally in FIG. 1 and is depicted schematically in FIG. 2. The exemplary handheld electronic device 4 includes a case 6 upon which is disposed an operational apparatus that can be said to comprise an input apparatus 8, an output apparatus 12, and a processor apparatus 16. The processor apparatus 16 includes a processor 18 and a memory 20. The processor 18 may be, for instance and without limitation, a microprocessor (μP) and is responsive to inputs from the input apparatus 8 and provides output signals to the output apparatus 12. The processor 18 also interfaces with the memory 20. The memory 20 can be any one or more of RAM, ROM, EPROM, EEPROM, and/or other memory devices.

The input apparatus 8 includes a schematically depicted keypad 24 disposed on the case 6. Examples of handheld electronic devices are included in U.S. Pat. Nos. 6,452,588 and 6,489,950 which are incorporated by reference herein.

As can be seen in FIG. 1, the case 6 has a number of sound openings 28 formed therein. As employed herein, the expression "a number of" and variations thereof shall refer broadly to any nonzero quantity, including a quantity of one. The sound openings 28 are advantageously spaced from a first edge 32 of the handheld electronic device 4 and can generally be said to be formed in the case 6 at a front surface 36 of the handheld electronic device 4. The spacing of the sound openings 28 from the first edge 32 advantageously enables the user to form a seal between the user's ear and the front surface 36, which enables the user to hear sound produced through the sound openings 28. As employed herein, the expression "seal" and variations thereof shall refer broadly to a type of interface between two articles wherein fluid flow through the interface, i.e., between the articles, is resisted.

Figure 6:
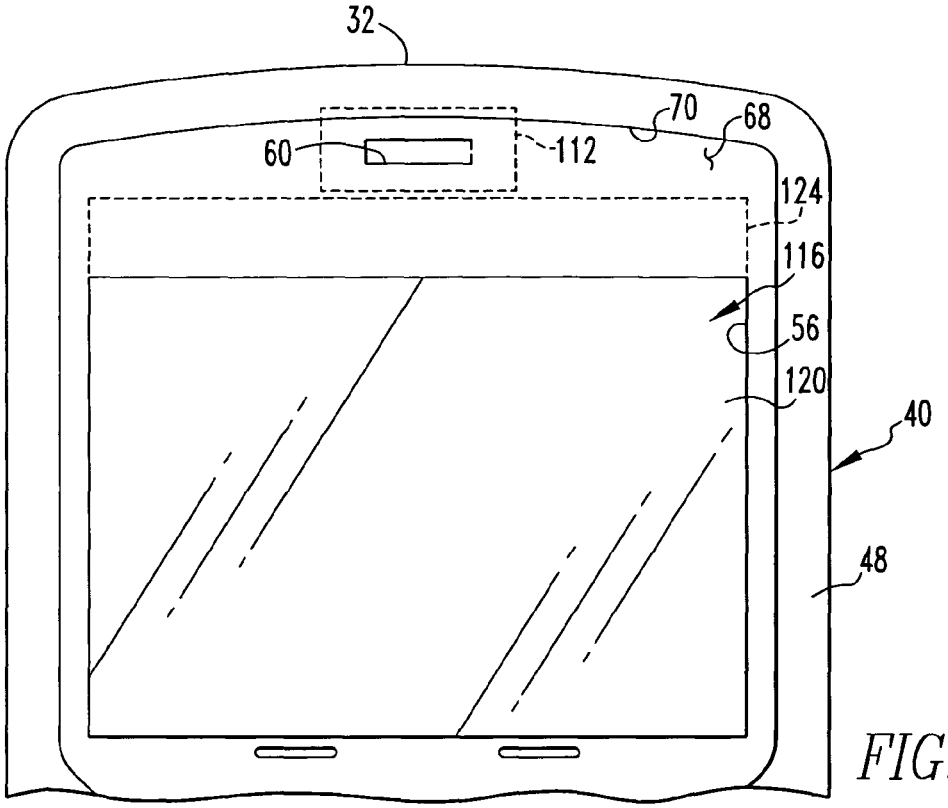
FIG. 6 is a view similar to FIG. 3, except having a lens of the handheld electronic device removed.
Figure 7:
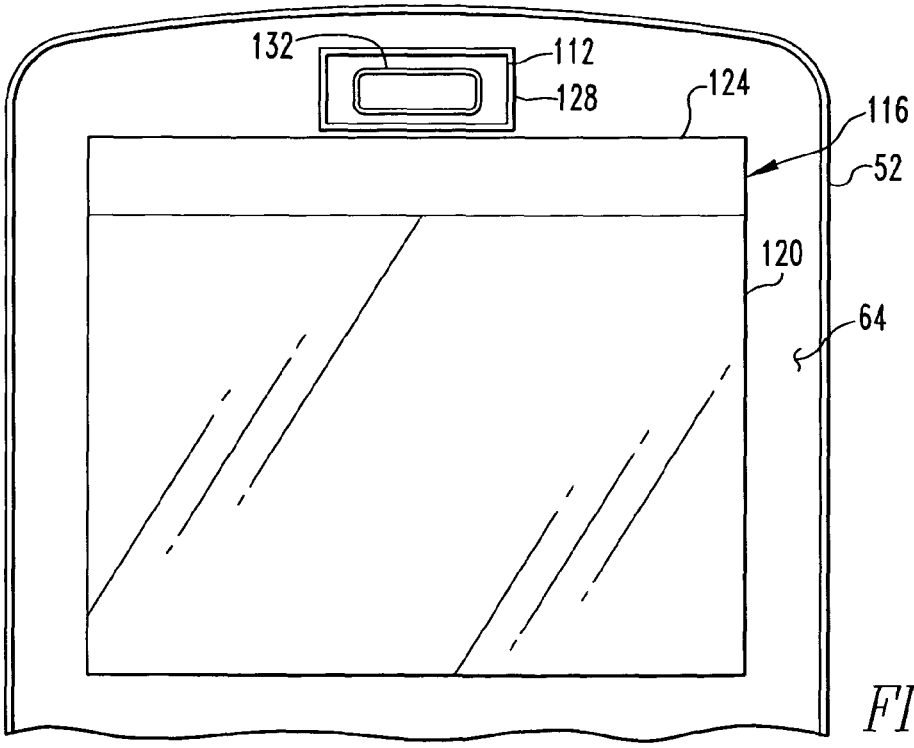
FIG. 7 is a view of a portion of an interior region of the handheld electronic device of FIG. 1.

The case 6 includes a housing 40 and a lens 44, with the lens 44 being disposed on the housing 40. In the present embodiment the lens 44 can be said to serve as a cover, it being understood that other types of covers may be employed in different embodiments. The housing 40 includes a front portion 48 and a rear portion 52 (FIG. 7). FIG. 6 generally depicts the handheld electronic device 4 with the lens 44 removed. FIG. 7 depicts the handheld electronic device 4 with the front portion 48 of the housing 40 additionally removed. As is best shown in FIG. 6, the front portion 48 has a window 56 and a transducer hole 60 formed therein. The front and rear portions 48 and 52 when assembled together have a hollow interior region 64 (FIG. 7) disposed generally therebetween. The window 56 is in communication with the interior region 64.

Figure 4:
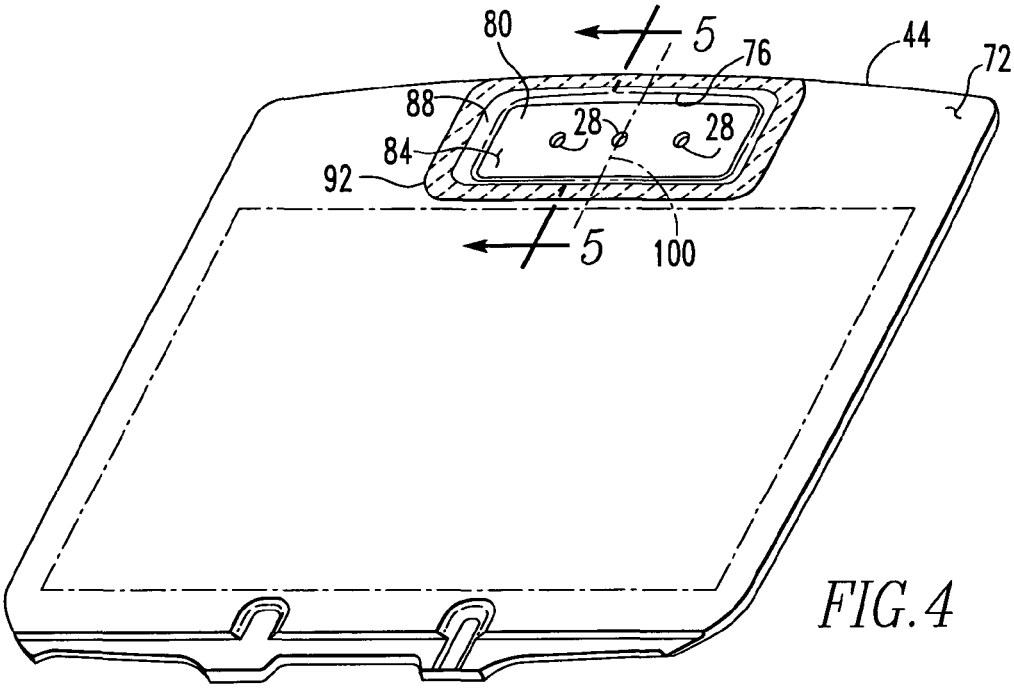
FIG. 4 is a perspective view of a portion of the handheld electronic device.

The front portion 48 includes a first housing surface 68 (FIG. 6) disposed adjacent the window 56. In the present exemplary embodiment, the front portion 48 has a seat 70 formed therein within which the lens 44 is disposed. The first housing surface 68 is generally disposed in the front portion 48 within the seat 70. As can be seen in FIG. 4, the lens 44 has a first lens surface 72. When assembled, the first lens surface 72 is disposed on the first housing surface 68.

As can further be seen in FIG. 4, the lens 44 has an indentation 76 formed therein adjacent the first lens surface 72. The lens 44 thus includes a floor portion 80 adjacent the indentation 76, with the floor portion 80 having a floor surface 84 adjacent the indentation 76. The lens 44 also has a peripheral surface 88 adjacent the indentation 76 that extends between the floor surface 84 and the first lens surface 72. A periphery about the indentation 76 is indicated generally at the numeral 92 on the portion of the first lens surface 72 surrounding the indentation 76. It can be seen that the sound openings 28 are formed in the floor portion 80 of the lens 44.

When the first lens surface 72 is disposed on the first housing surface 68, the periphery 92 about the indentation 76 is sealed to the opposing portion of the first housing surface 68 to form a substantially sealed cavity 96 between at least a portion of the lens 44 adjacent the first lens surface 72 and at least a portion of the housing 40 adjacent the first housing surface 68. Such a seal can be formed in any of a variety of ways, such as with the use of adhesives, welding techniques, forming techniques, and the like.

It is understood that the cavity 96 is substantially sealed, except that the transducer hole 60 and the sound openings 28 are in fluid communication with an interior of the cavity 96 and with the exterior of the cavity 96. The cavity 96 is elongated along a first axis indicated generally at the numeral 100 in FIG. 4. The first axis 100 is oriented substantially parallel with the floor surface 84. As can be understood from FIGS. 4 and 5, the cavity 96 is elongated along another axis transverse to the first axis 100, whereby the cavity 96 can be said to be elongated along a plane defined by the first axis 100 and the axis transverse thereto.

Figure 5:
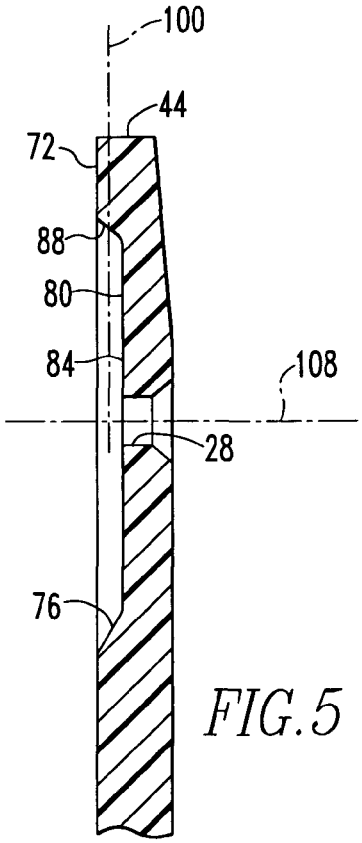
FIG. 5 is a sectional view as taken along line 5-5 of FIG. 4.

As can further be seen in FIGS. 4 and 5, the sound openings 28 in the present exemplary embodiment extend through the floor portion 80 along a second axis 108 that is oriented substantially orthogonal to the first axis 100. Other configurations in other embodiments are possible.

Figure 3:
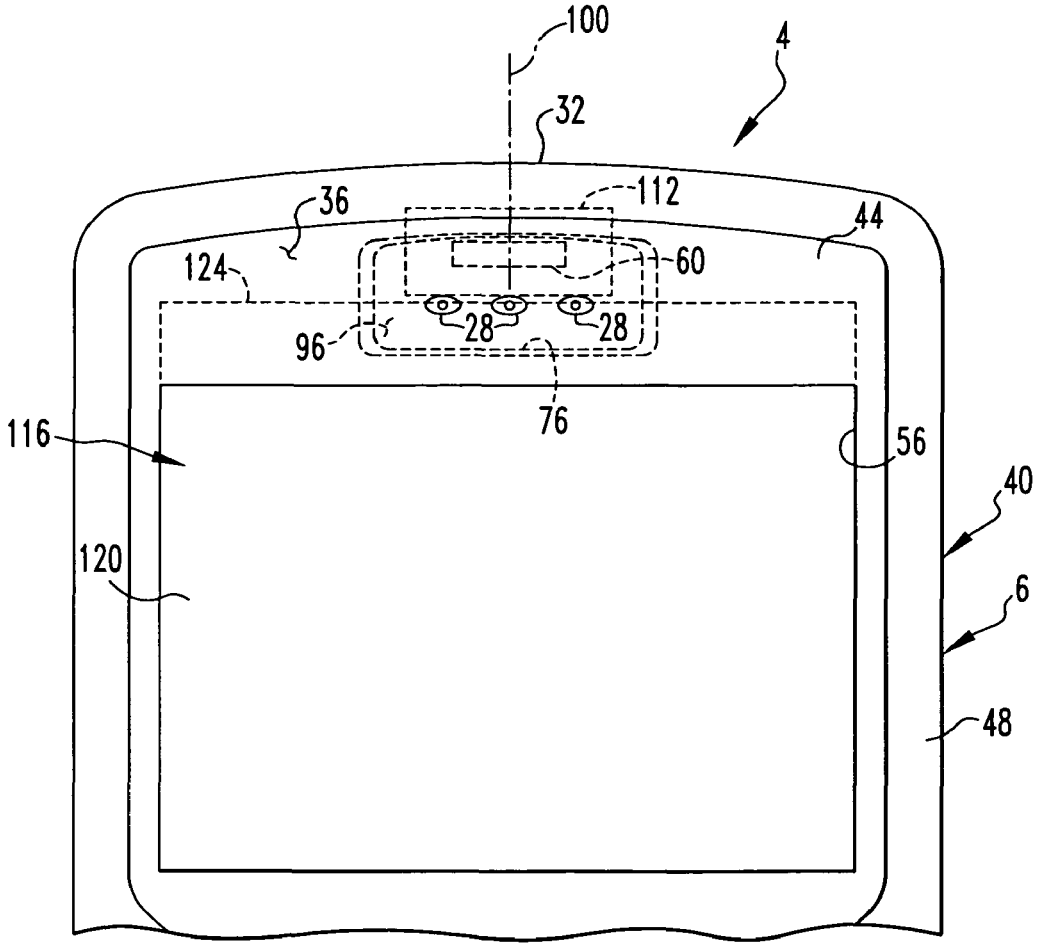
FIG. 3 is an enlarged front elevational view of a portion of the handheld electronic device of FIG. 1.

As is best understood in FIGS. 3 and 7, the output apparatus 12 includes an audio transducer 112 and a display 116 disposed on the rear portion 52 of the housing 40. The audio transducer 112 in the present example is a loudspeaker disposed in a receptacle 128 (FIG. 7) on the rear portion 52. The display 116 includes a screen 120 and a connection apparatus 124. The display 116 and the audio transducer 112 are disposed within the interior region 64 of the housing 40. The screen 120 is disposed adjacent the window 56 and is visible through the window 56 to an observer disposed at the exterior of the housing 40. It is understood that the atmosphere is disposed generally at the exterior of the housing 40.

The connection apparatus 124 is connected (not shown in FIG. 7) with the processor apparatus 16. As can be seen in FIG. 7, the audio transducer 112 disposed in the receptacle 128 is disposed adjacent the connection apparatus 124 of the display 116. As is understood in the relevant art, the display 116 is a unitary structure, and the connection apparatus 124 provides the means by which the screen 120 is operatively connected with the processor apparatus 16 to enable signals from the processor apparatus 16 to be provided to the screen 120 for visual output.

A gasket 132 is depicted in FIG. 7 as being disposed atop a sound-producing element of the audio transducer 112. The gasket 132 forms a seal against the underside (not expressly depicted herein) of the front portion 48 in the region surrounding the transducer hole 60 to provide a substantially airtight seal between the audio transducer 112 and the front portion 48, which enables sound produced by the audio transducer 112 to travel through the cavity 96 between the transducer hole 60 and the sound openings 28.

The lens 44 is at least partially translucent and at least partially overlies the screen 120. As employed herein, the expression "translucent" and variations thereof shall refer broadly to a quality that permits the passage of light and may include a transparent quality wherein light is transmitted without appreciable scattering so that it does not meaningfully alter light waves traveling therethrough.

As can be understood from FIG. 3, the audio transducer 112 is disposed closely adjacent the first edge 32 of the case 6. The centers of the sound openings 28 are spaced farther from the first edge 32 than a center of the audio transducer 112. In the present exemplary embodiment, the center of the audio transducer 112 is indicated generally by the placement of the transducer hole 60, as in FIG. 6.

The cavity 96 in the present exemplary embodiment is configured to form a Helmholtz resonator that enables sounds produced by the audio transducer 112 to be received through the transducer hole 60, into the interior of the cavity 96, and out of the sound openings 28 where the sounds can be heard by a user, such as when the user has formed a seal between the user's ear and the front surface 36 of the case 6. In the present exemplary embodiment, the cavity 96 has an interior volume on the order of about 150 cubic millimeters, although other configurations may be appropriate. In the present exemplary embodiment, the centers of the sound openings 28 are spaced about 13-16 millimeters from the first edge 32, and the spacing, center-to-center, between the outermost sound openings 28 is about 10-12 millimeters, although other configurations may be appropriate.

The exemplary indentation 76 is formed in the lens 44 and is of a depth of about 0.6-0.8 millimeters, although other configurations could be employed. It is also noted that in other embodiments a portion of the indentation 76 could be formed in the front portion 48 of the housing 40 without departing from the present concept. That is, the cavity 96 could be formed in both the lens 44 and the housing 40 depending on the desired configuration.

It is understood that telephone communication typically occurs in the range of about 300-3400 hertz, and that a transducer such as the audio transducer 112 typically operates in the 300-2000 hertz range. The audio transducer 112 typically will produce frequencies above 2000 hertz only at a relatively low amplitude. The Helmholtz resonator provided by the cavity 96, the transducer hole 60, and/or the sound openings 28 is tuned to about 3000 hertz, thus amplifying those relatively higher frequencies that typically would be at a relatively small amplitude from the audio transducer 112, and generally leaving other frequencies alone. As such, the Helmholtz resonator provided by the case 6 can be said to be configured to provide relatively better audio response in certain respects than the audio response of the audio transducer 112 by itself. It is noted that the audio signals generated by the audio transducer 112 are typically the subject of digital signal processing according to an acoustic model that takes into consideration the frequency response of the cavity 96 to provide an overall desirable frequency output at the sound openings 28.

The cavity 96 thus advantageously enables the sound openings 28 to be spaced away from a position directly above the audio transducer 112 to a position offset therefrom along the first axis 100. The audio transducer 112, being in fluid communication with the cavity 96 though the transducer hole 60, enables sounds from the audio transducer 112 to be communicated to the interior of the cavity 96. The sound openings 28, which are in fluid communication with both the interior of the cavity 96 and the atmosphere, enable sounds produced by the audio transducer 112 and provided to the cavity 96 to be transmitted through the cavity 96, through the sound openings 28, and into the atmosphere.

In this regard, when the user has at least partially formed a seal between the user's ear and the front surface 36 of the case 6, the sounds desirably can enter the ear and can be accurately perceived by the user. The cavity 96 is thus configured to extend between a first position adjacent (i.e., above, from the perspective of FIG. 3) the audio transducer 112, and thus adjacent (i.e., above, from the perspective of FIG. 3) the transducer hole 60, and a second position adjacent (i.e., above, from the perspective of FIG. 3) the display 116. It can be understood that the display 116 serves as a limiting feature or structure that limits placement of the audio transducer 112 to a position at most adjacent, but not above (from the perspective of FIG. 3,) the display 116.

The cavity 96 advantageously enables the sound openings 28 to be positioned at a location that is desirable for the transmission of sound into the interior of the user's ear without particular regard for the precise location of the audio transducer 112. Moreover, the sound openings 28 are spaced along the first axis 100 from the transducer hole 60. It additionally can be seen that the sound openings 28, from the perspective of FIG. 3, overly at least a portion of the display 116 and, more specifically, a portion of the connection apparatus 124. It is understood, however, that other configurations of the cavity 96 and other positionings of the sound openings 28 with respect to the audio transducer 112 and/or with respect to the first edge 32 can be employed. The sound openings 28 can be spaced from the audio transducer 112, yet desirably would not be disposed above the screen 120 where they otherwise might interfere with the user's visual perception of the screen 120.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A handheld electronic device comprising:

a case comprising a housing having a first housing surface and a transducer hole for part of an output apparatus; and a lens having an interior lens surface, the interior lens surface formed to mate with the first housing surface and the lens having a first region and a second region having an indentation formed in the interior lens surface, the second region being thinner than the first region;

the output apparatus comprising an audio transducer and a display disposed in the housing disposed over a first axis;

a cavity formed by the indentation with the transducer hole when the interior lens surface is mated with the first housing surface to cover the transducer hole, the cavity having a length along the first axis and disposed adjacent to, and not behind, the display;

the audio transducer being in fluid communication with the cavity;

the case having at least a first opening formed therein in fluid communication with the cavity and the atmosphere; and the at least a first opening being spaced along the first axis from the audio transducer.

2. The handheld electronic device of claim 1 wherein at least a first opening is also formed by the lens.

3. The handheld electronic device of claim 2 wherein the lens is at least partially translucent.

4. The handheld electronic device of claim 2 wherein the lens comprises a floor portion adjacent the indentation, the floor portion having a floor surface adjacent the indentation, the lens further comprising a peripheral surface adjacent the indentation, the peripheral surface being disposed between the floor surface and the first cover surface, the first axis being disposed generally parallel with the floor surface.

5. The handheld electronic device of claim 1 wherein the housing and the lens are sealed together about a periphery of the cavity.

6. A handheld electronic device comprising:

a case comprising a housing having a first housing surface and a transducer hole for part of an output apparatus; and a cover having an interior surface, the interior surface formed to mate with the first housing surface, the cover having an interior surface, the interior surface formed to mate with the first housing surface and the cover having a first region and a second region having an indentation formed in the interior surface with the second region being thinner than the first region, the indentation forming a cavity in the case when the interior surface is mated with the first housing surface, the cavity having a length along a first axis and disposed adjacent to, and not behind, a display of the electronic device;

the output apparatus comprising an audio transducer and a structure disposed on the case, the audio transducer and structure disposed over the first axis;

the audio transducer being disposed adjacent to, and not behind, the structure;

the cavity extending between a first position adjacent the audio transducer and a second position adjacent the structure;

the audio transducer being in fluid communication with the cavity;

the case having at least a first opening formed therein in fluid communication with the cavity and with the atmosphere; and the at least a first opening being spaced along the first axis from the audio transducer.

7. The handheld electronic device of claim 6 further comprising a processor, wherein the output apparatus further comprises a display, the display comprising a screen and a connection apparatus connected with the processor, the connection apparatus being the structure.

8. The handheld electronic device of claim 6 wherein the indentation and the at least a first opening are formed in the cover, and wherein the cover is a lens that is at least partially translucent.

9. The handheld electronic device of claim 8 wherein the at least a first opening extends through the lens in a direction along a second axis substantially perpendicular to the first axis.

10. The handheld electronic device of claim 6 wherein the housing and the cover are sealed together about the periphery of the cavity.

11. The handheld electronic device of claim 7 wherein the at least a first opening overlies at least a portion of the connection apparatus.

12. A handheld electronic device comprising:

a case comprising a housing having a first housing surface the housing having an interior region formed therein and having a window formed therein in communication with the interior region, at least a portion of the first housing surface being disposed adjacent the window; and a lens being at least partially translucent and having an interior lens surface, at least a portion of the interior lens surface being disposed on at least a portion of the first housing surface at least a portion of the lens overlying at least a portion of the window and at least a portion of the screen adjacent the window the lens having a first region and a second region having an indentation formed in the interior surface with the second region being thinner than the first region, the indentation being disposed between and forming a cavity in the case between at least a portion of the housing adjacent the first housing surface and at least a portion of the lens adjacent the first lens surface, the cavity being disposed adjacent to, and not behind, the display;

a processor apparatus comprising a processor and a memory disposed on the housing;

an output apparatus comprising an audio transducer and a display disposed on the housing, the display comprising a screen and a connection apparatus connected with the processor apparatus, the audio transducer and displayed disposed over a first axis;

at least a portion of the display being disposed within the interior region adjacent the window; and the audio transducer being in fluid communication with the cavity.

13. The handheld electronic device of claim 12, wherein the cavity has a length along the first axis, the at least a first opening being spaced along the first axis from the audio transducer.

14. The handheld electronic device of claim 13 wherein the lens comprises a floor portion adjacent the indentation, the floor portion having a floor surface adjacent the indentation, the lens further comprising a peripheral surface adjacent the indentation, the peripheral surface being disposed between the floor surface and the first lens surface, the first axis being disposed generally parallel with the floor surface.

15. The handheld electronic device of claim 13 wherein the at least a first opening extends through the lens in a direction along a second axis substantially perpendicular to the first axis.

16. The handheld electronic device of claim 12 wherein the at least a first opening overlies at least a portion of the connection apparatus.

17. The handheld electronic device of claim 12 wherein the housing has an audio transducer hole formed therein, the audio transducer being in fluid communication with the cavity through the audio transducer hole, the cavity having a length along the first axis, the at least a first opening being spaced along the first axis from the audio transducer hole.

18. The handheld electronic device of claim 12 wherein the housing and the lens are sealed together about a periphery of the cavity.

* * * * *